US009788619B2

(12) United States Patent
Beadles

(10) Patent No.: US 9,788,619 B2
(45) Date of Patent: Oct. 17, 2017

(54) SUITCASE

(71) Applicant: Robert Dale Beadles, Lodi, CA (US)

(72) Inventor: Robert Dale Beadles, Lodi, CA (US)

( * ) Notice: Subject to any disclaimer, the term of this patent is extended or adjusted under 35 U.S.C. 154(b) by 87 days.

(21) Appl. No.: 14/517,821

(22) Filed: Oct. 18, 2014

(65) Prior Publication Data

US 2015/0034520 A1 Feb. 5, 2015

Related U.S. Application Data

(63) Continuation-in-part of application No. 14/256,899, filed on Apr. 18, 2014.

(60) Provisional application No. 61/813,574, filed on Apr. 18, 2013.

(51) Int. Cl.

| | |
|---|---|
| ***A45C 15/00*** | (2006.01) |
| ***A45C 5/03*** | (2006.01) |
| ***A45C 13/26*** | (2006.01) |
| ***A45C 5/14*** | (2006.01) |
| ***A45C 5/00*** | (2006.01) |
| ***A45C 13/08*** | (2006.01) |
| ***A63H 3/00*** | (2006.01) |
| *A63H 3/28* | (2006.01) |

(52) U.S. Cl.

CPC ..... *A45C 5/14* (2013.01); *A45C 5/00* (2013.01); *A45C 13/08* (2013.01); *A63H 3/005* (2013.01); *A45C 2200/00* (2013.01); *A63H 3/28* (2013.01)

(58) Field of Classification Search

CPC ..... A45C 13/08; A45C 2200/00; A45C 5/00; A45C 5/14; A63H 3/005; A63H 3/28

See application file for complete search history.

(56) References Cited

U.S. PATENT DOCUMENTS

| | | | | |
|---|---|---|---|---|
| 3,846,868 | A * | 11/1974 | Brydolf | E05F 1/1269 16/255 |
| 4,105,242 | A * | 8/1978 | Terbeek | A61G 1/0562 280/30 |
| 5,855,276 | A * | 1/1999 | Smith, Jr. | A45C 13/08 150/117 |
| 2004/0043373 | A1 * | 3/2004 | Kaiserman | G09B 7/02 434/350 |

* cited by examiner

*Primary Examiner* — Yong Hang Jiang

(74) *Attorney, Agent, or Firm* — Franklin & Associates International Inc; Matthew F. Lambrinos

(57) ABSTRACT

A container comprising a bag simulative of an animal with a plurality of storage compartments. The present container for items and personal effects for travel will be seen to provide not only a useful container for the transportation of goods, but also serve as a fashion accessory for people of all ages. The container is also easy to use, and provides for a more ergonomic option as it only requires gentle pulling to activate the rear leg wheel system for the transportation of the container. When the tension has been released to a preset tension, the rear leg wheel system will retract, and the container resembling an animal will "sit down," and can also provide other entertainment at the time with other gestures such as panting, yawning, or wagging its tail, for example.

20 Claims, 11 Drawing Sheets

SUITCASE

CROSS REFERENCE TO RELATED PATENT APPLICATIONS

This patent application is a continuation in part of U.S. Non-Provisional patent application Ser. No. 14/256,899, filed on Apr. 18, 2014, entitled "Suitcase", which claims benefit from U.S. Provisional Patent Application Ser. No. 61/813,574, filed Apr. 18, 2013, the entire content of each of these applications are incorporated by reference herein as if fully set forth.

BACKGROUND

1. Field of the Invention

The present invention relates generally to an aesthetically appealing container with retractable legs (supports) and realistic movements. The present container is a realistic representation of an animal with cavities with closures that allow a user, children and adults alike, to fill these cavities with personal effects in preparation for travel, including but not limited to, air travel, sea travel, automobile travel, etc. The said container is further capable of realistic movements that give a representation of user to be walking the animal as they transport the container during their travels. Also, the container also can provide realistic expressions such as movement of the face, ears, nose, neck, and tail and may even make sounds, for example.

2. Description of the Prior Art

Many suitcases, carriers, backpacks, and diaper bags in the shapes of animals, have been developed, produced, and patented over the years. In U.S. Pat. No. 5,855,276, issued Jan. 5, 1999, Smith, Jr. discusses a carrier bag simulative of an animal (horse), with a rocking base for carrying articles associated with infants. In U.S. Design Pat. No. D340,578, issued Oct. 26, 1993, Winkos provides for figures of an ornamental design for an children's animal suitcase in the shape of a dog. It is unclear in the disclosure what and how this suitcase functions.

None of the above inventions and patents, taken either singly or in combination, is seen to describe instant invention as claimed. Current U.S. Classification: 206/457; D3/235; D3/45; D3/71; 150/117; 190/111; 206/542 International Classification: B65D 30/10; A45C 3/00

BRIEF SUMMARY

According to some embodiments, the present technology is directed to a container for items, comprising: (a) a body that is shaped like an animal, the body comprising both front and rear appendages that are each hingedly attached to the body, each of the front and rear appendages comprising a wheel, the body forming a compartment for receiving and retaining the items; and (b) a handle associated with the body, upward movement the handle causing rear appendages to transition into a sitting position, downward movement of the handle while in the sitting position causing the front appendages to transition into a prone position.

According to some embodiments, the present technology is directed to a container for items, comprising: (a) a body that is shaped like an animal, the body comprising both front and rear appendages that are each hingedly attached to the body, each of the front and rear appendages comprising a wheel, the body forming a compartment for receiving and retaining an object; (b) a handle associated with the body, upward movement the handle causing rear appendages to transition into a sitting position, downward movement of the handle while in the sitting position causing the front appendages to transition into a prone position; (c) a processor; and (d) a memory for storing executable instructions, the processor executing the instructions to: (i) receive input or commands from a user; and (ii) in response to the input or commands, provide any of: (1) an audio response; and (2) a visible response.

According to some embodiments, the present technology is directed to a container for items, comprising a body that is shaped like an animal, the body comprising both front and rear appendages that are each hingedly attached to the body, each of the front and rear appendages comprising a wheel, the body forming a compartment for receiving and retaining an object, wherein at least one of front and rear appendages are selectively movable so as to allow the body to be disposed in any of a standing, a sitting, or a prone position.

DETAILED DESCRIPTION AND BEST MODE OF IMPLEMENTATION

Figure 1:
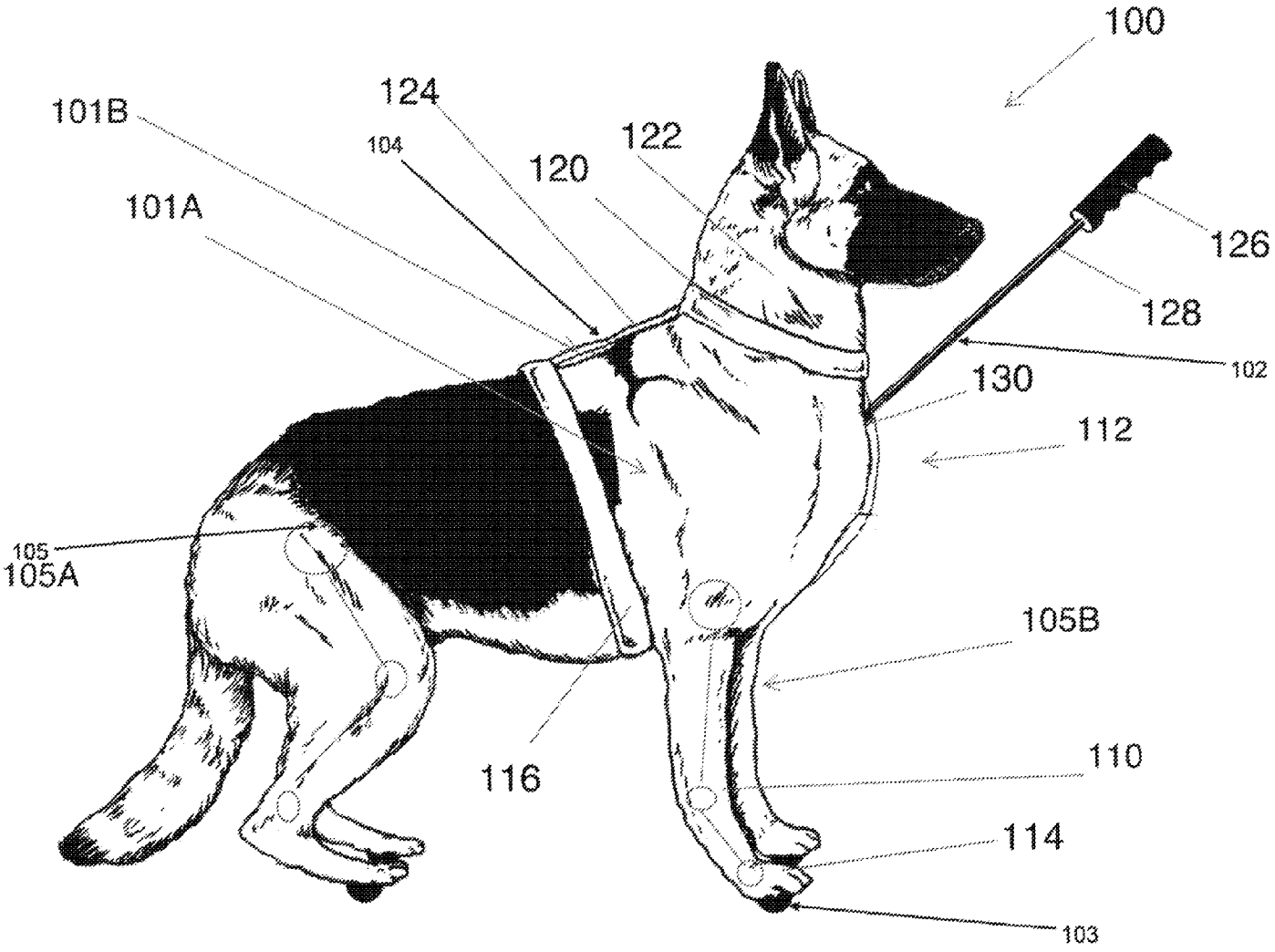
FIG. 1 shows an illustration of a suitcase according to one embodiment.

The present invention is a carrier for items or articles related to travel. With increasing regulation and demand for rigorous and effective containers suitable for travel by the TSA, this container provides a means of carrying and storing virtually any type of article or item that may be required while traveling. The present invention also provides an aesthetically pleasing container and realistic movements that mimic those of animals.

The present invention comprises a container simulative of an animal, not only having numerous compartments suitable for the storage of personal effects, but also providing realistic movements including, but not limited to, expressions of the face, ears, nose, neck, and tail for example.

Accordingly, is a principal object of the invention to provide a carrier for that carrier which and storage of articles and personal effects in association with travel for people of all ages.

It is another object of the present invention to provide a carrier for having relatively large, and usable, storage compartments.

It is yet another object of the invention to provide a carrier that is simulative of an animal in both shape, and function (realistic movements).

In summary, the present container for items and personal effects for travel will be seen to provide not only a useful container for the transportation of goods, but also serve as a fashion accessory for people of all ages. The container is also easy to use, and provides for a more ergonomic option as it only requires gentle pulling to activate the rear leg wheel system for the transportation of the container. When the tension has been released to a preset tension, the rear leg wheel system will retract, and the container resembling an animal will "sit down," and can also provide other entertainment at the time with other gestures such as panting, yawning, or wagging its tail, for example.

It is to be understood that the present invention is not limited to the embodiments described above, but encompasses any and all embodiments within the scope of the following claims.

These and other objects of the present invention will become immediately apparent upon further review of the following specification and drawings.

This invention relates to a container simulative of an animal, not only having numerous compartments suitable for the storage of personal effects, but also providing realistic movements including, but not limited to, expressions of the face, ears, nose, neck, and tail for example. It even can make realistic sounds unique to the type of animal.

Accordingly, is a principal object of the invention to provide a carrier for that carrier which and storage of articles and personal effects in association with travel for people of all ages.

It is another object of the present invention to provide a carrier for having relatively large, and usable, storage compartments.

It is yet another object of the invention to provide a carrier that is simulative of an animal in both shape, and function (realistic movements, gestures and sounds). For the animals that do not have a forward and rearward set of legs, the set of legs are defined also by a forward and rearward portion such as a whale or dolphin or other marine life for example.

These and other objects of the present invention will become immediately apparent upon further review of the following specification and drawings.

FIG. 1 of the accompanying drawings shows an illustration of a suitcase 101 according to one embodiment, and in this particular example the suitcase resembles a dog. This suitcase is pulled and operated by handle 102, and suitcase is rolled on wheels 103. Item 104 serves as both a harness and a closure allowing the user to pick up the suitcase or keep the contents of the said suitcase retained within the suitcase. For example, items can be retained in a compartment 101A. The closure 101B is located at the base of the neck 122 of the body 112.

The rearward portion of the animal, and in this instance, the rear appendages/hind legs of the dog are activated by a rear hinge-joint assembly 105A.

Figure 5:
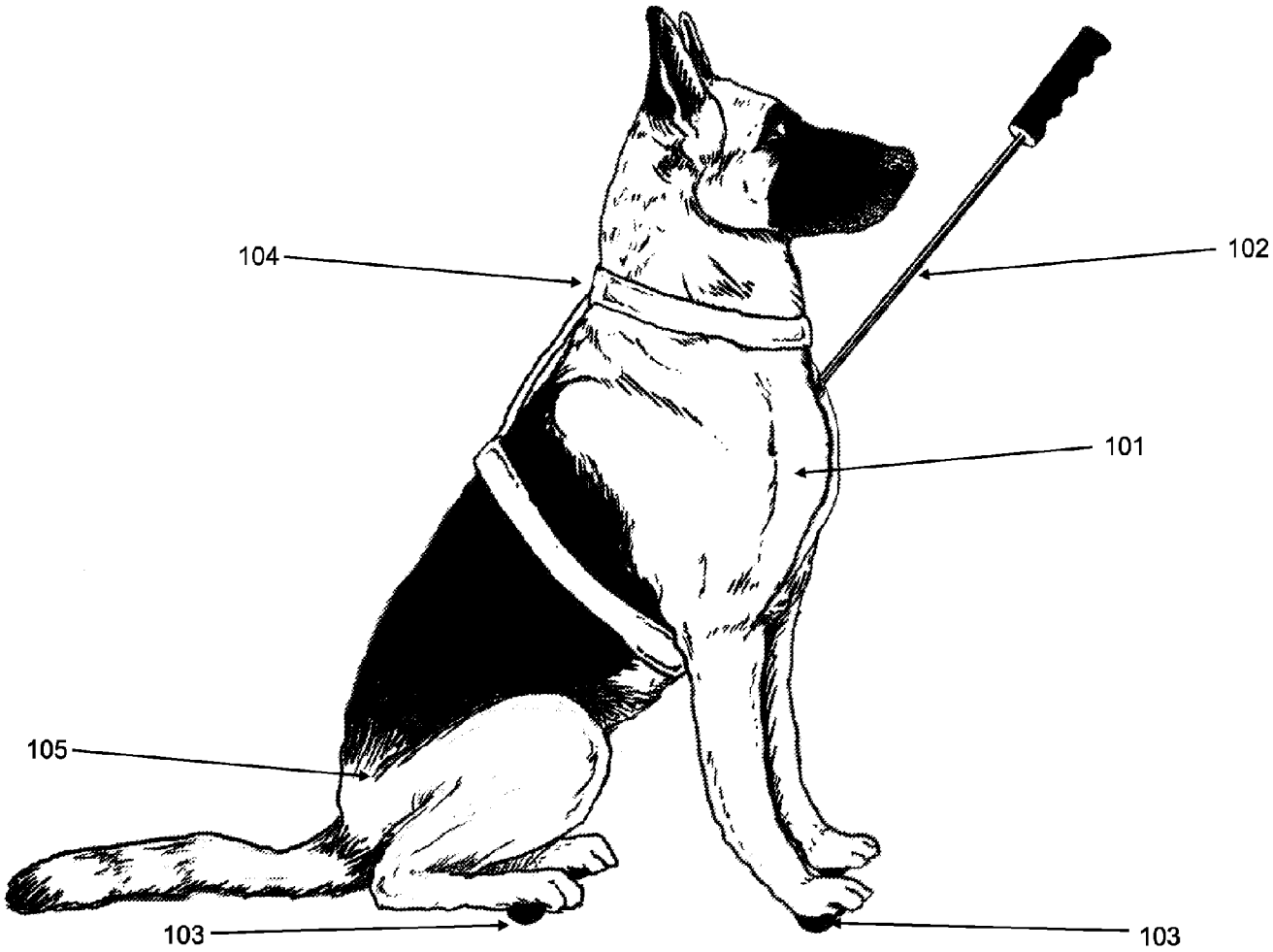
FIG. 5 represents the suitcase (the dog) in a "heel" mode.

A front hinge-joint assembly 105A is associated with the front appendages. Various movements between the front and rear hinge-joint assemblies 105A and 105B are employed to allow the suitcase 101 to assume various positions such as standing up (FIG. 1), laying down (FIG. 3), and heel (FIG. 5).

In some embodiments, a wheel 103 is associated with each appendage, such as appendage 110 of a body 112 of the suitcase. In additional embodiments, a wheel can be associated with a foot 114 of an appendage 110.

The strap 104 comprises a first encircling strap 116 that overlaps a torso 118 of the body 112 and a second encircling strap 120 that overlaps a neck 122 of the body 112. A handle 124 of the strap 104 extends between the first encircling strap 116 and the second encircling strap 120.

The handle 102 comprises a grip portion 126 and an elongated shaft 128 that connects proximate the neck 122 under a mouth 128 of the suitcase 101. The elongated shaft 128 pivotally connects to the suitcase allowing for pivoting, lateral movement relative to a joint 130 provided in the neck 122. The pivoting, lateral movement of the elongated shaft 128 allows a user to steer the suitcase 101.

In some embodiments, the elongated shaft 128 allows for longitudinal pivoting (e.g., up and down) relative to the joint 130. Thus, when a user moves the elongated shaft 128 upwardly, the suitcase 101 can transition into a prone position (see FIG. 3). More specifically, the movement of the elongated shaft 128 upwardly causes the rear hinge-joint assembly 105A to collapse the rear appendages, moving the suitcase 101 into a heel position (see FIG. 5). The rear hinge-joint assembly 105A is preloaded with a preset tension that keeps the suitcase 101 in the walking position of FIG. 1. When the preset tension is released by moving the elongated shaft 128 upwardly, the rear hinge-joint assembly 105A will retract or hinge, and the suitcase 101 resembling an animal will "sit down,"

Figure 3:
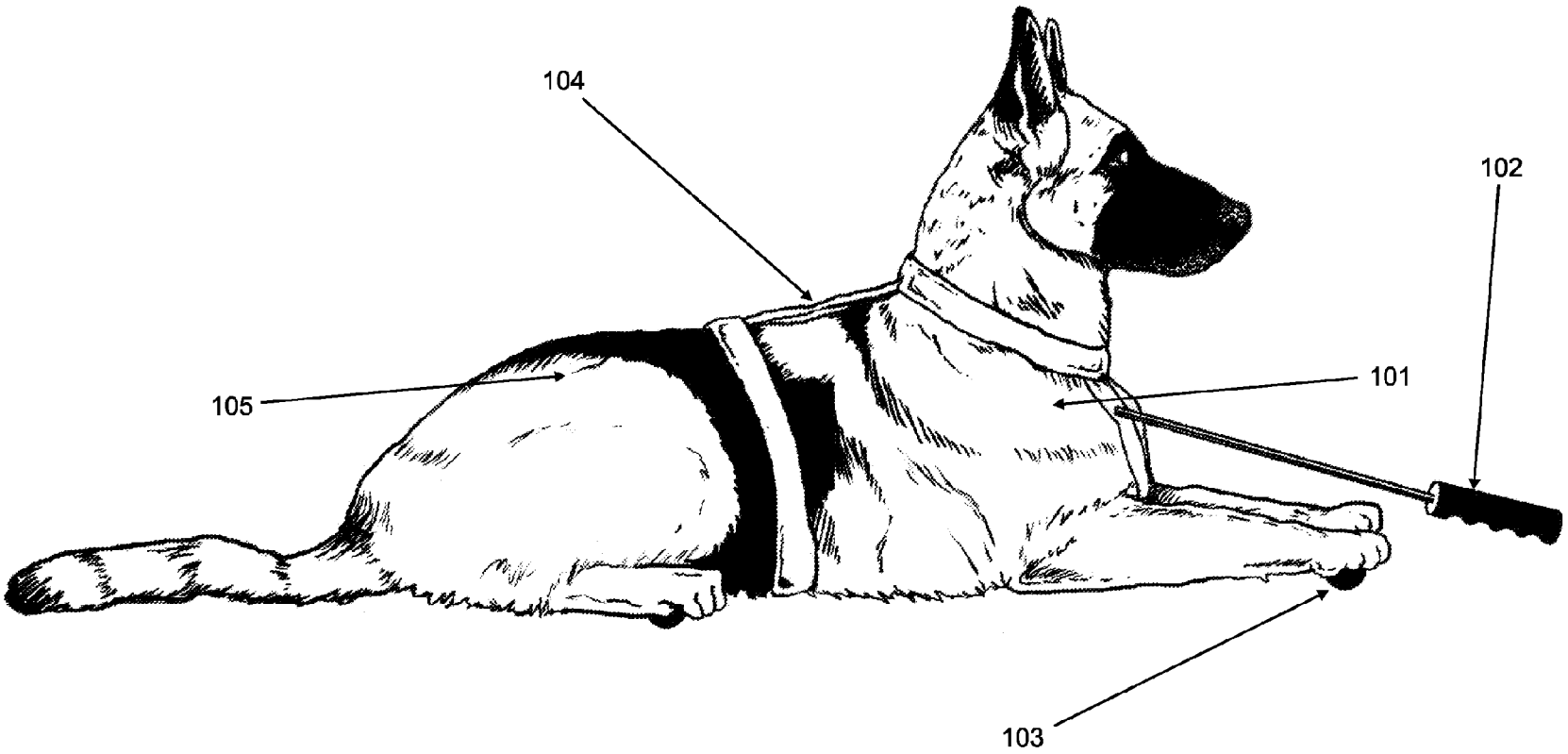
FIG. 3 represents the suitcase (the dog) laying down.

Subsequent movement of the elongated shaft 128 downwardly, while the suitcase is in the heel position, causes the front hinge-joint assembly 105B collapses the front appendages, transitioning the suitcase 101 into a prone position (see FIG. 3). As with the rear hinge-joint assembly 105A, the front hinge-joint assembly 105B is pre-tensioned to keep the front appendages in a walking/sitting position. When the preset tension is released by moving the elongated shaft 128 downwardly, the front hinge-joint assembly 105B will retract or hinge, and the suitcase 101 resembling an animal will "heel,"

Figure 2:
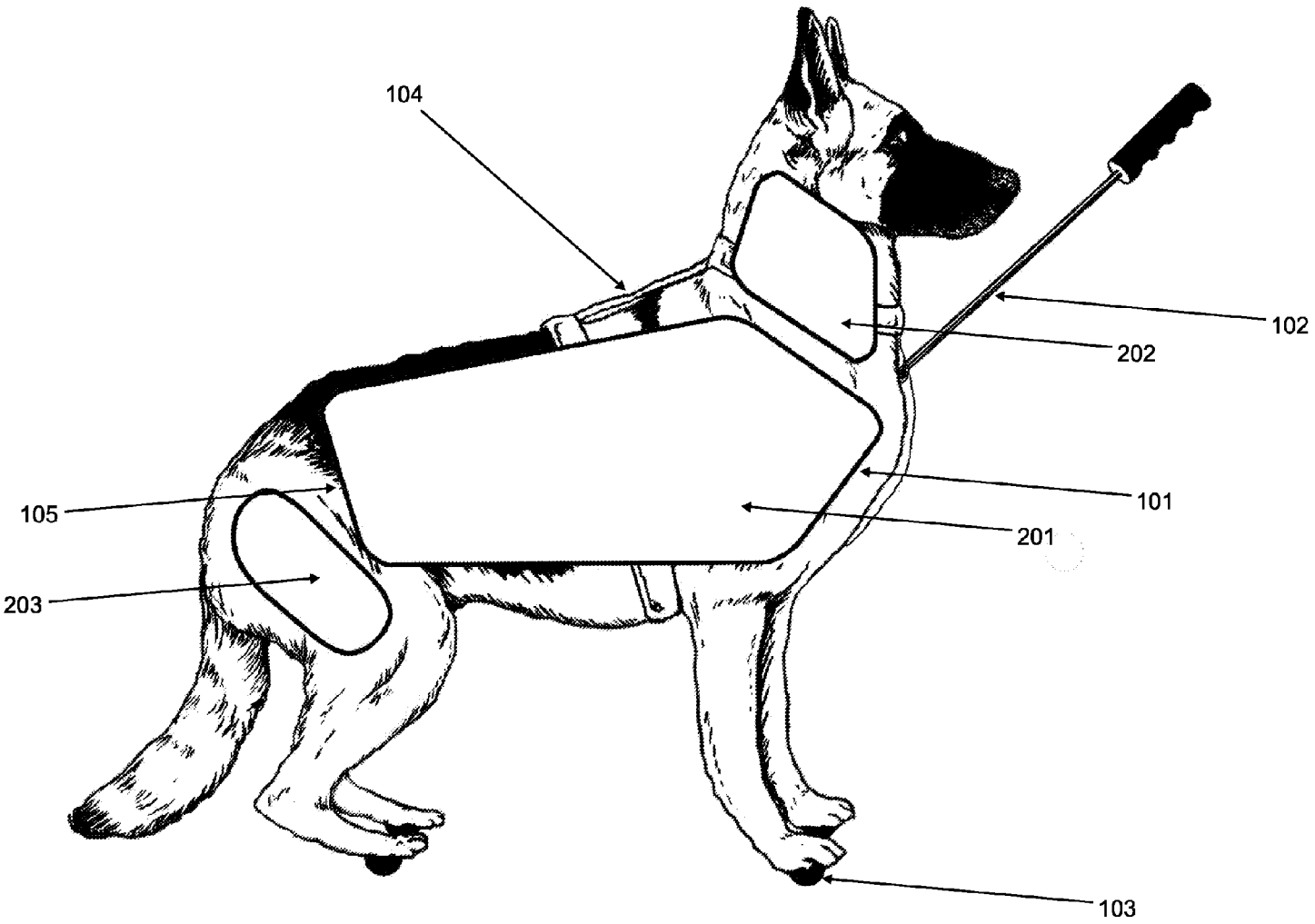
FIG. 2 shows some compartments and features of the suitcase of FIG. 1.

FIG. 2 shows some of the compartments of the suitcase 101 and some of the other features from FIG. 1 with 201 representing a main compartment, 202 and 203 representing smaller, auxiliary compartments. Compartment 201 is disposed along side a right side of a torso 210 of the suitcase 101. Compartment 202 is positioned on a right side of the neck 122 of the suitcase 101. Compartment 203 is positioned on a right portion of an appendage 110 of the suitcase 101.

FIG. 3 represents the suitcase (the dog) laying down.

Figure 4:
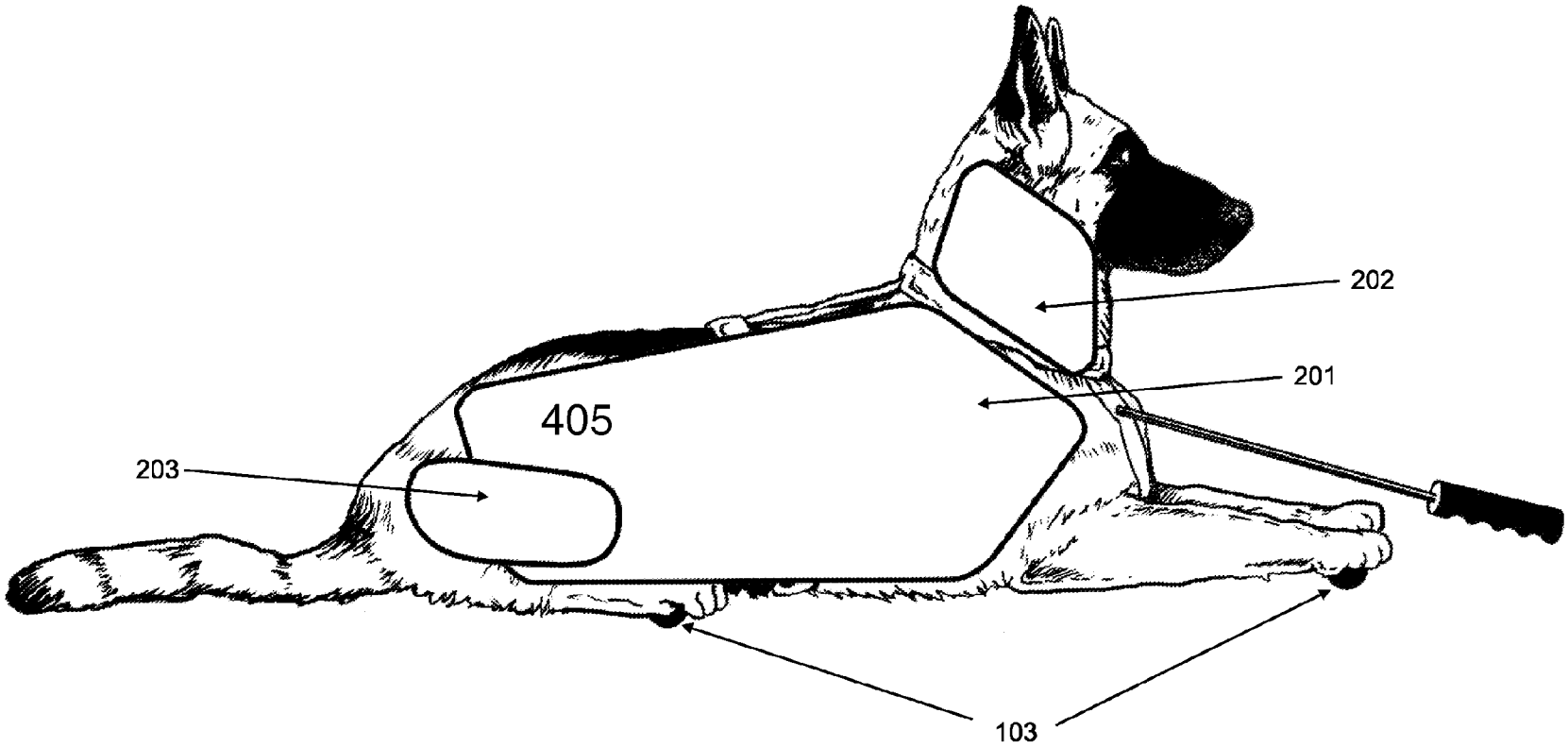
FIG. 4 shows some of the compartments and other features from FIGS. 1 and 3.

FIG. 4 shows some of the compartments of the suitcase 101 and some of the other features from FIGS. 1 and 3, with 201 representing a main compartment, 202 and 203 representing smaller, auxiliary compartments. When the suitcase 101 is in the sitting position, shown in FIGS. 3-4, the compartment 203 overlaps at least a portion of an outer surface 405 of the compartment 201. The compartment 201 and compartment 202 do not overlap.

FIG. 5 represents the suitcase (the dog) in a "heel" mode actuated by the hinge-joint assembly 105.

Figure 6:
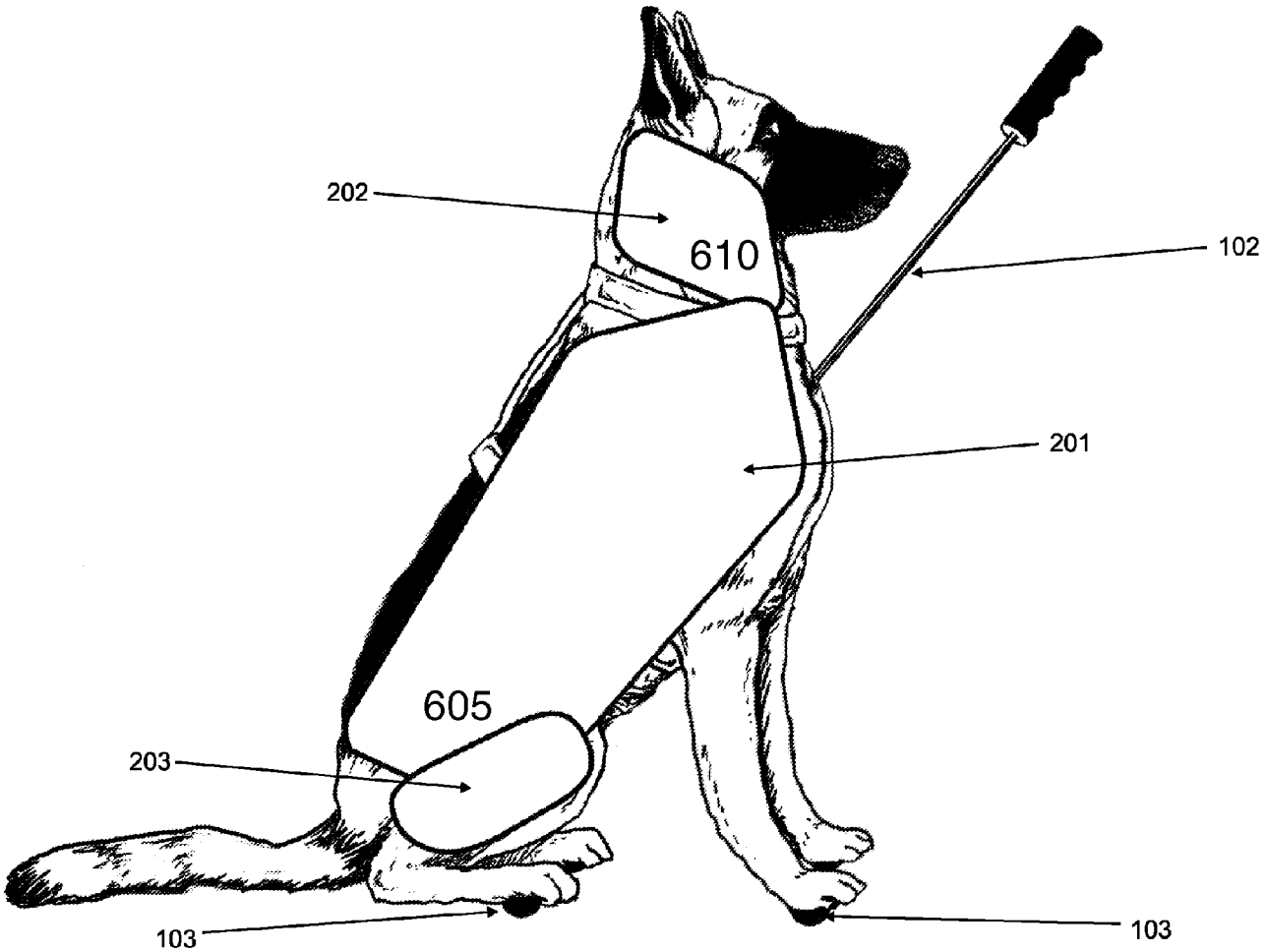
FIG. 6 shows some of the compartments and other features from FIGS. 1 and 4.

FIG. 6 shows some of the compartments of the suitcase 101 and some of the other features from FIGS. 1 and 4, with 201 representing a main compartment, 202 and 203 representing smaller, auxiliary compartments. When the suitcase 101 is in the heel position, shown in FIGS. 5-6, the compartment 203 overlaps at least a portion of an outer surface 605 of the compartment 201. Additionally, a portion of an upper part of the compartment 201 overlaps an outer surface 610 of the compartment 202. Thus, the compartments 201-203 are disposed in a layered configuration when the suitcase 101 is in a heel position.

Figure 7:
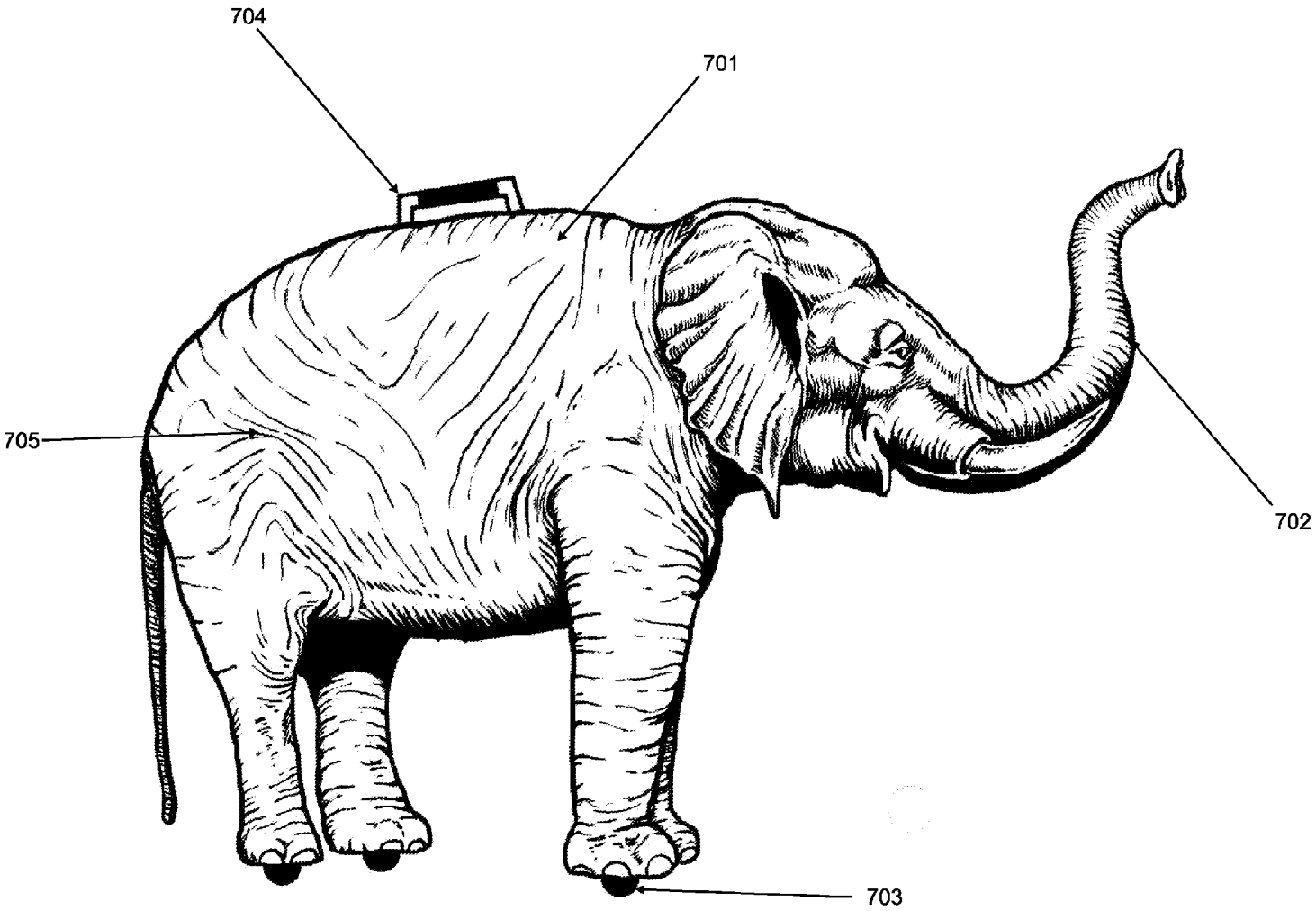
FIG. 7 shows an illustration of suit case according to another embodiment.

FIG. 7 shows an illustration of a suitcase 701 according to another embodiment, and in this particular example suitcase represents an elephant. The suitcase is pulled and operated by handle 702, and suitcases rolled on wheels 703. Item 704 serves as both a harness and a closure allowing the user to pick up the suitcase or keep the contents of the said suitcase retained within the suitcase. The rearward portion of the animal, and in this example the hind legs of the elephant are activated by a hinge-joint assembly 705, that allows the suitcase to stand up, lay down and "heel".

Figure 8:
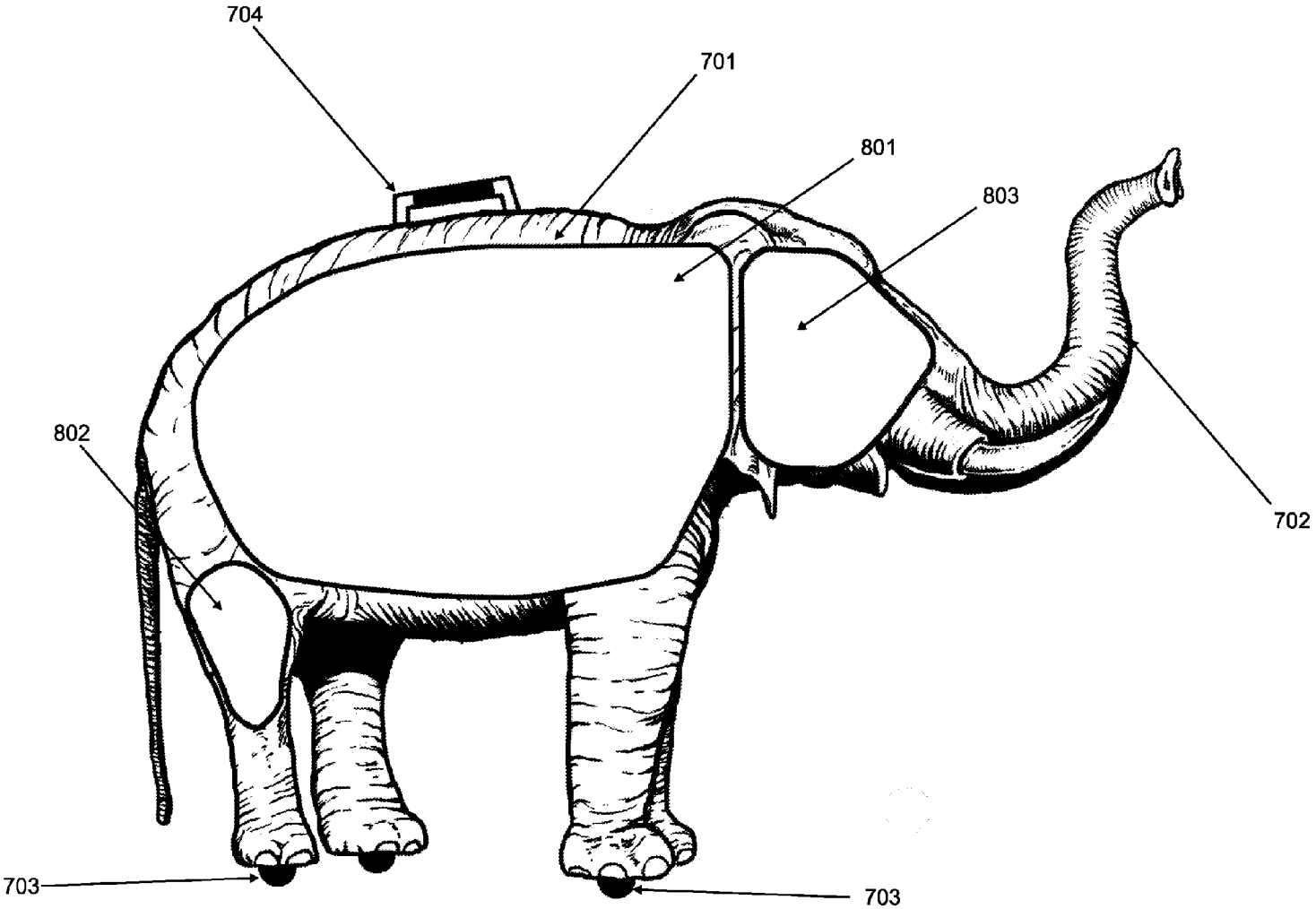
FIG. 8 shows some of the compartments and other features of the suitcase of FIG. 7.

FIG. 8 shows main compartment 801 and auxiliary compartments 802 and 803, and some of the other features outlined in FIG. 7.

Figure 9:
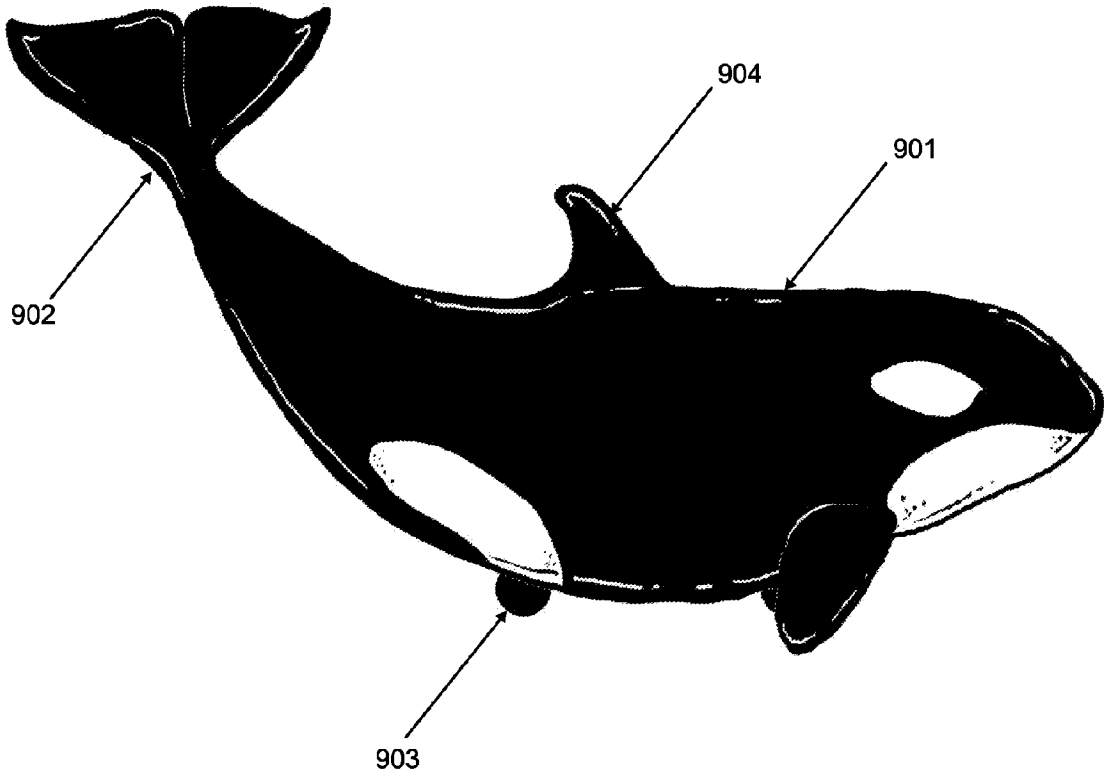
FIG. 9 shows an illustration of a suitcase according to another embodiment.

FIG. 9 shows an illustration of suitcase 901 according to another embodiment, and in this particular example the suitcase resembles a marine creature, specifically but not limited to a killer whale. This suitcase is pulled and operated by the handle 902, and suitcase is rolled on wheels 903. This suitcase can also be operated by handle 904.

Figure 10:
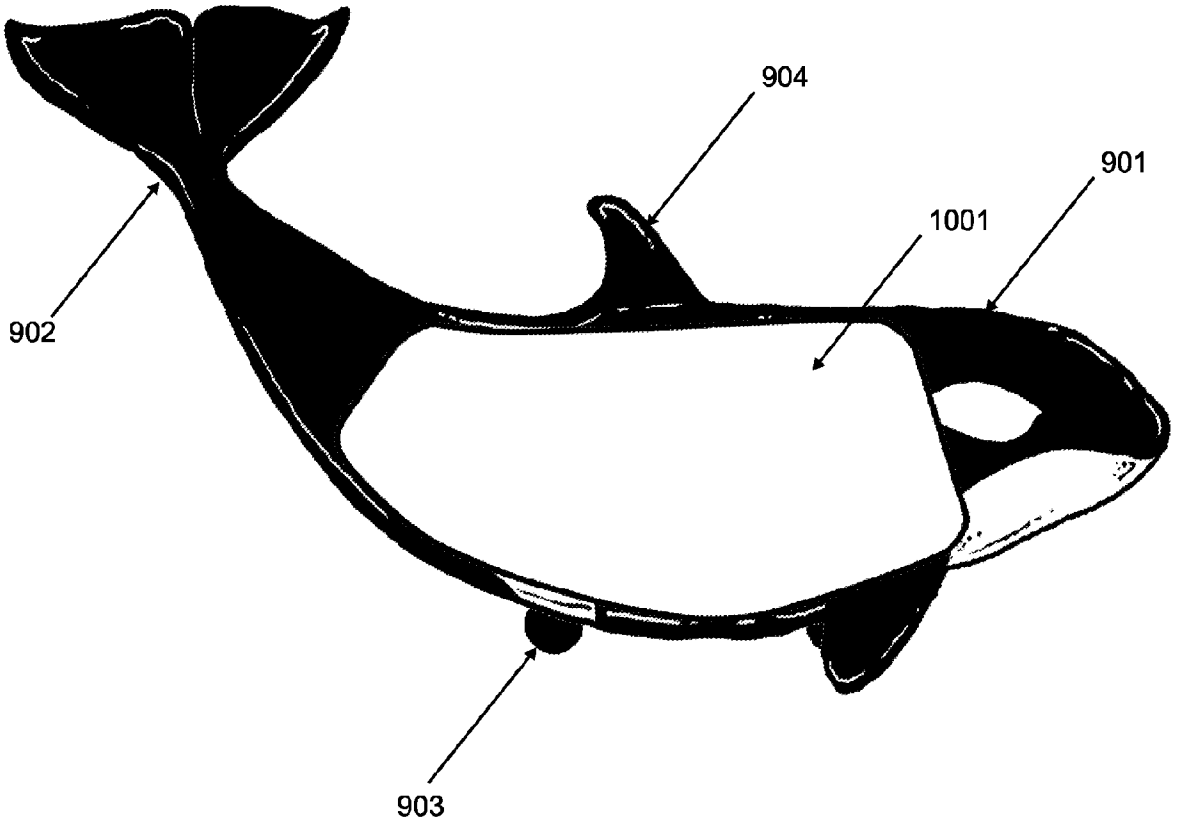
FIG. 10 shows some of the compartments of the suitcase of FIG. 9.

FIG. 10 shows some of the compartment(s) 1001 of suitcase 901, and some of the other features outlined in FIG. 9.

Figure 11:
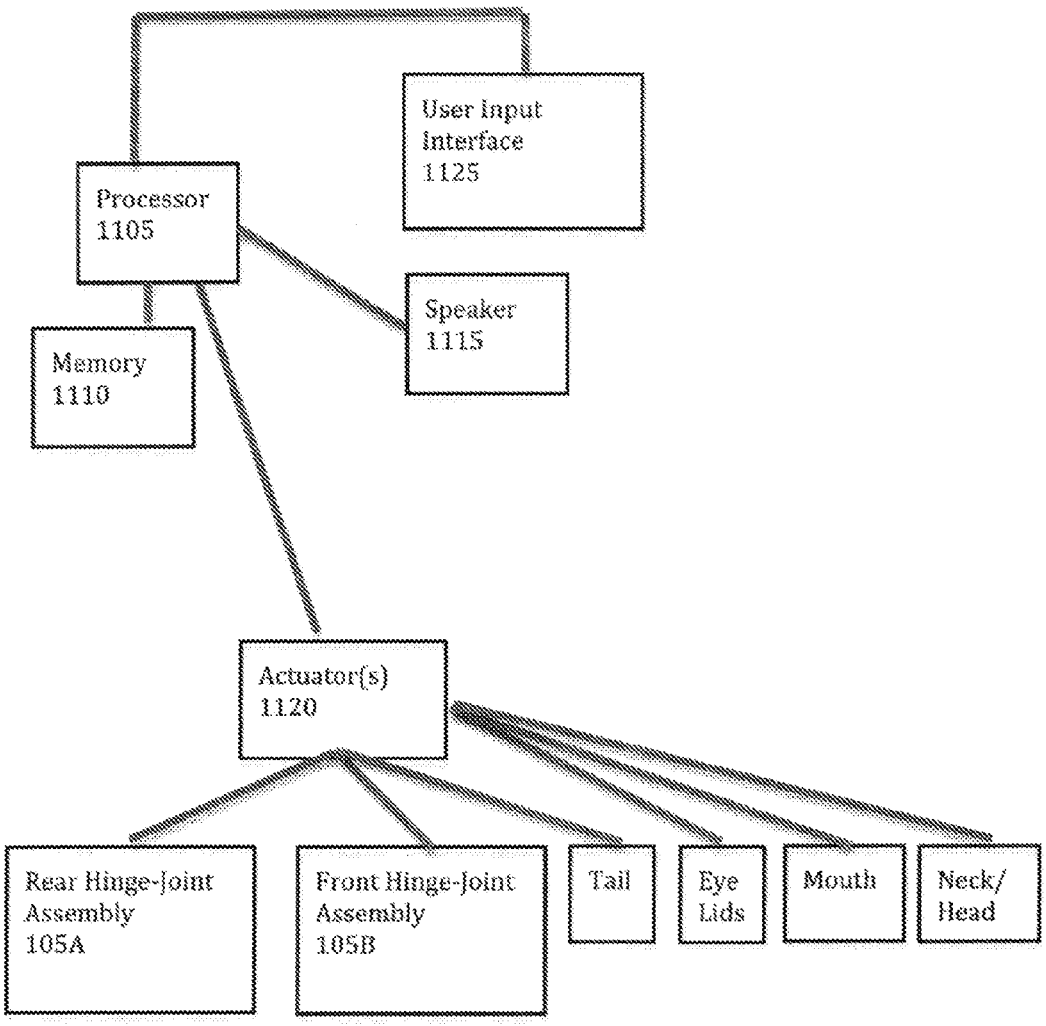
FIG. 11 is a schematic diagram of an example container having a microprocessor.

FIG. 11 is a schematic diagram of an example microprocessor 1100 that is used to provide simulated feedback or output by a suitcase. By way of example, the microprocessor 1100 can comprise a processor 1105 and memory 1110. The memory stores executable instructions for controlling various features of the suitcase. In one embodiment, the instructions when executed by the processor 1105 cause a speaker 1115 disposed within the suitcase (potentially near the mouth) to output a barking sound or growl. The suitcase can also comprise actuators 1120 that are associated with, for example, the tail or eyelids of the suitcase. The processor 1105 can be control these various body parts by providing signals to an actuator(s) associated with the body parts.

In some embodiments, the suitcase comprises a receiver 1120 that receives audio input, such as spoken commands. The processor 1105 can cause the suitcase to provide feedback such as tail wagging, barking, and so forth in response to commands from a user. Feedback can include any one or combination of audio or visual responses. For example, a visual response can include any of a wagging tail, movement of one or more of the appendages, blinking of eyes of a head of the body, opening and closing of a mouth of the head, movement of the head relative to a neck of the body, or combinations thereof. Again, these movements are controlled by the processor 1105 selectively activating or deactivating the actuators 1120.

Also, in some embodiments, actuators are associated with the rear and front hinge-joint assemblies 105A and 105B. When a voice command such as "sit" or "heel" is received, the processor 1105 causes the rear hinge-joint assembly 105A to move into the heel position. Likewise when a voice command such as "lay down" is received, the processor 1105 causes the rear hinge-joint assembly 105A to move into the prone position.

Feedback or actions caused by the processor 1105 can be caused by any user input such as a voice commands, button responses (where the user depresses buttons on the suitcase), movements of the handle 124 (e.g., upward and downward), and so forth. In one embodiment, a user input interface 1125 is coupled with the suitcase and processor 1105. This user input interface 1125 can include the handle 124 (see FIG. 1), a keypad, one or more buttons, as well as other input devices that would be known to one of ordinary skill in the art.

It will be understood that while the example above contemplated feedback or output that would be commonly associated with a dog, the processor can implement different types of instructions based on the "animal" represented by the suitcase. For example, the suitcase of FIG. 7 can be programmed to react or act as an elephant, while the embodiments of FIGS. 9 and 10 can be programmed to react or act like a killer whale.

While preferred embodiments of the present invention have been described and illustrated in detail, it is to be understood that many modifications can be made to the embodiments, and features can be interchanged between embodiments, without departing from the spirit of the invention.

What is claimed is:

1. A container for items, comprising:

a body that is shaped like an animal, the body comprising both front and rear appendages that are each hingedly attached to the body, each of the front and rear appendages comprising a wheel, the body forming a compartment for receiving and retaining an object; and a handle associated with the body, upward movement of the handle causing rear appendages to transition into a sitting position, downward movement of the handle while in the sitting position causing the front appendages to transition into a laying down position such that the body contacts a laying surface, the front appendages hinged so as to extend forward of the body when in the laying down position.

2. The container according to claim 1, wherein the handle comprises a grip portion and an elongated shaft, the elongated shaft being coupled to a joint on the body.

3. The container according to claim 2, wherein the joint is proximate a neck and under a mouth of the body.

4. The container according to claim 1, wherein rear appendages are associated with a hinge-joint assembly that is preset with tension to keep the rear appendages in a standing position.

5. The container according to claim 4, wherein upward movement of the handle is required to overcome the tension thereby allowing the rear appendages to transition into the sitting position.

6. The container according to claim 1, further comprising a first compartment associated with a neck of the body.

7. The container according to claim 6, further comprising a second compartment associated with the torso of the body.

8. The container according to claim 7, further comprising a third compartment associated with a leg of the body.

9. The container according to claim 8, wherein the third compartment overlaps at least a portion of the second compartment when the body is in the sitting position.

10. The container according to claim 9, wherein the third compartment overlaps at least a portion of the second compartment and the second compartment overlaps at least a portion of the first compartment when the body is in the prone position.

11. A container for items, comprising:

a body that is shaped like an animal, the body comprising both front and rear appendages that are each hingedly attached to the body, each of the front and rear appendages comprising a wheel, the body forming a compartment for receiving and retaining an object;

a handle associated with the body, upward movement of the handle causing rear appendages to transition into a sitting position, downward movement of the handle while in the sitting position causing the front appendages to transition into a laying down position such that the body contacts a laying surface, the front appendages hinged so as to extend forward of the body when in the laying down position;

a processor; and a memory for storing executable instructions, the processor executing the instructions to:

receive input or commands from a user; and in response to the input or commands, provide any of: an audio response; and a visible response.

12. The container according to claim 11, wherein the input or commands include movement of the handle.

13. The container according to claim 12, wherein the audio response comprises an animal sound that corresponds to the shape of the animal.

14. The container according to claim 13, wherein the visual response comprises any of a wagging tail, movement of one or more of the appendages, blinking of eyes of a head of the body, opening and closing of a mouth of the head, movement of the head relative to a neck of the body, or combinations thereof.

15. The container according to claim 14, further comprising a first compartment associated with a neck of the body.

16. The container according to claim 15, further comprising a second compartment associated with the torso of the body.

17. The container according to claim 16, further comprising a third compartment associated with a leg of the body.

18. The container according to claim 17, wherein the third compartment overlaps at least a portion of the second compartment when the body is in the sitting position.

19. The container according to claim 18, wherein the third compartment overlaps at least a portion of the second compartment and the second compartment overlaps at least a portion of the first compartment when the body is in the prone position.

20. A container for items, comprising:

a body that is shaped like an animal, the body comprising both front and rear appendages that are each hingedly attached to the body, each of the front and rear appendages comprising a wheel, the body forming a compartment for receiving and retaining an object, wherein at least one of front and rear appendages are selectively movable upon movement of a handle associated with the body, upward movement of the handle causing rear appendages to transition into a sitting position, downward movement of the handle while in the sitting position causing the front appendages to transition so as to allow the body to be disposed in a prone laying down position such that the body contacts a laying surface, the front appendages hinged so as to extend forward of the body when in the laying down position.

* * * * *